US007177234B1

(12) United States Patent
Paul

(10) Patent No.: US 7,177,234 B1
(45) Date of Patent: Feb. 13, 2007

(54) WRISTWATCH WITH REMOVABLE FACE

(76) Inventor: Gary Paul, 36 Gilbert Ave., Paramus, NJ (US) 07652

( * ) Notice: Subject to any disclaimer, the term of this patent is extended or adjusted under 35 U.S.C. 154(b) by 0 days.

(21) Appl. No.: 11/412,666

(22) Filed: Apr. 27, 2006

(51) Int. Cl.
*G04B 37/00* (2006.01)
*A44C 5/00* (2006.01)

(52) U.S. Cl. ..... 368/88; 368/281

(58) Field of Classification Search ..... 368/88, 368/223, 228, 276, 281, 285, 294, 299, 300
See application file for complete search history.

(56) References Cited

U.S. PATENT DOCUMENTS 4,600,992 A * 7/1986 Boudreau et al. ..... 710/241
4,796,240 A * 1/1989 Stevens ..... 368/281
5,008,869 A * 4/1991 Dweck ..... 368/228
5,018,118 A * 5/1991 Ross ..... 368/228
5,224,078 A * 6/1993 Mallin ..... 368/223
5,787,055 A * 7/1998 Alpert ..... 368/223
5,793,710 A * 8/1998 Jacobi, Jr. ..... 368/223
6,118,735 A * 9/2000 Li ..... 368/228
6,416,217 B1 * 7/2002 Von Braunhut ..... 368/278
6,819,632 B1 * 11/2004 Paul ..... 368/88

* cited by examiner

*Primary Examiner*—Vit Miska
*Assistant Examiner*—Thanh S. Phan
(74) *Attorney, Agent, or Firm*—Amster, Rothstein & Ebenstein, LLP

(57) ABSTRACT

A wristwatch including a casing having top and bottom parts and a movement therein, an upper housing, a replaceable watch face and a means for releasably securing the upper housing to the top part of the casing. The upper housing is formed as an integral unit, and includes top and bottom transparent panels, a drive shaft means extending through the bottom transparent panel, the drive shaft means having top and bottom ends, time indicating hands fixed to the top ends of the drive shaft means, and side walls fixed to and maintaining the top and bottom transparent panels spaced apart to define a chamber therein for enclosing the time indicating hands. The replaceable watch face includes a memory element, and a flat panel display disposed over the memory element. The replaceable watch face is situated below the bottom transparent panel and above the casing top part, and the bottom end of the drive shaft means is releasably coupled to the movement.

5 Claims, 6 Drawing Sheets

FIG. 2
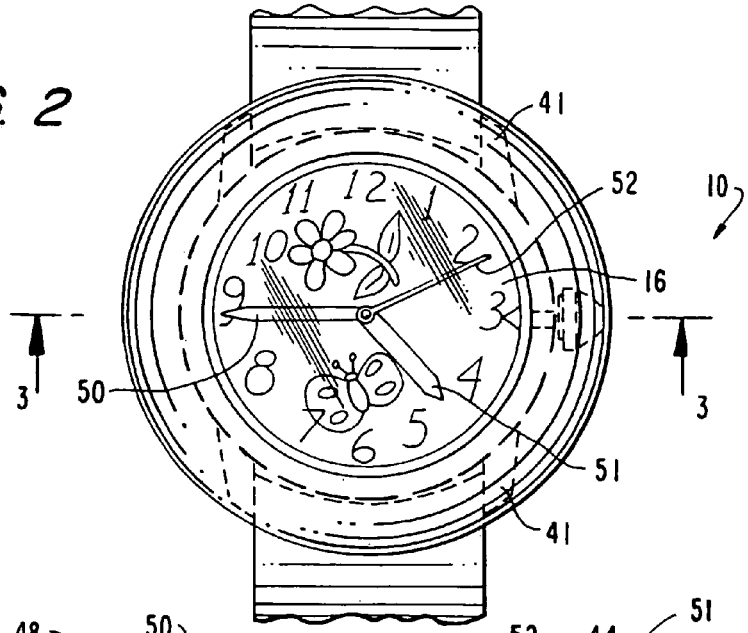
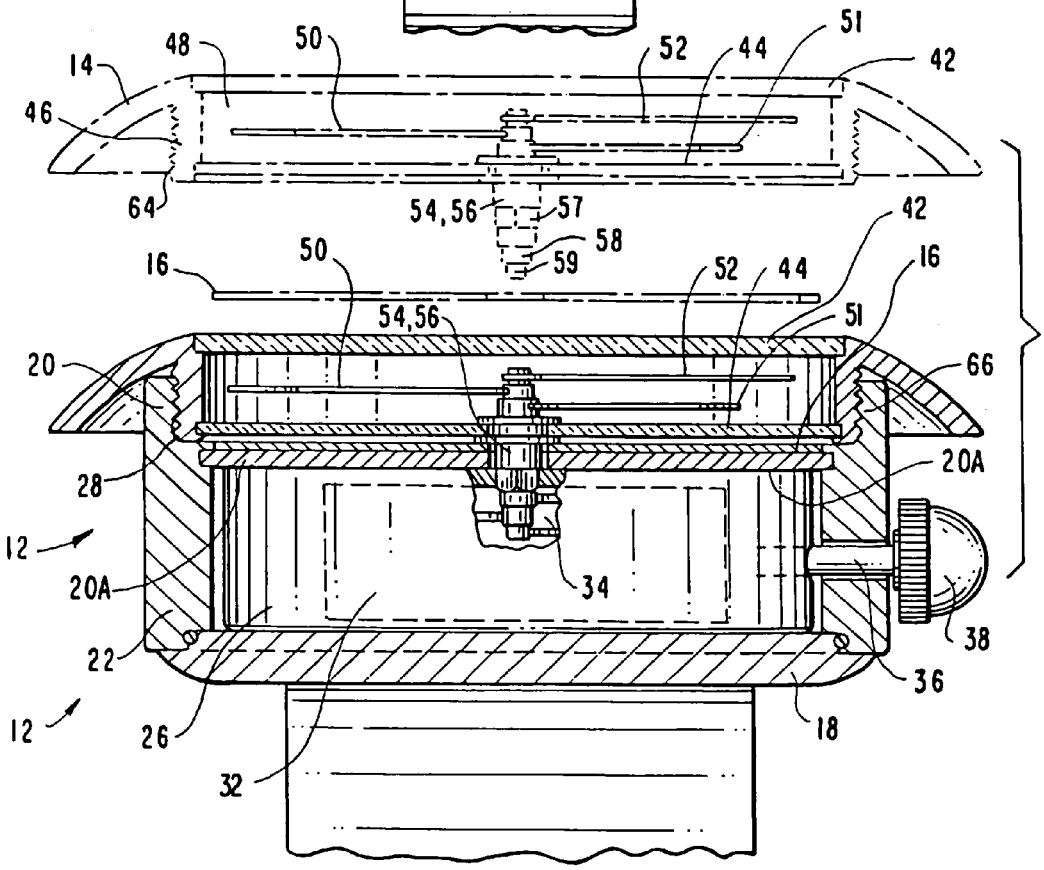
FIG. 3

WRISTWATCH WITH REMOVABLE FACE

FIELD OF THE INVENTION

This invention is in the field of wristwatches and more particularly wristwatches with removable watch faces.

BACKGROUND

It is known that wristwatches are one of the most commonly used devices in the world, and it is further known that for many persons a wristwatch is not only a timepiece but also is an accessory of dress and even a fashion statement. In the latter regard, it is desirable not only that a wristwatch be highly attractive, but also be one that coordinates or harmonizes with the other articles of dress, such as a person's suit, shirt or jewelry.

While some persons wear the same watch for all occasions and with all different attire, either because they cannot afford additional watches or because the dress coordination issue is not important to them, for others, one particular watch cannot possibly be acceptable for numerous different styles and levels of dress, from casual dress to business dress to formal dress. Further, in the case of the latter type of individuals, one watch is not likely to match particularly well with many different outfits within one of these dress categories.

The obvious solution, if one has the means, is to purchase numerous different watches for the different situations. Notwithstanding the differences in watches based on quality and design of the watch movement and of the casing and bracelet, the appearance of the watch face itself often has the most immediate visual impact.

This has led some innovators to make a watch changeable in appearance by having interchangeable watch faces. Numerous prior art patents, namely U.S. Pat. No. 4,660,992 to Paul et al., U.S. Pat. No. 4,796,240 to Stevens, U.S. Pat. No. 5,008,869 to Dweck, U.S. Pat. No. 5,018,118 to Ross, U.S. Pat. No. 5,168,479 to Lima, U.S. Pat. No. 5,787,055 to Alpert, U.S. Pat. No. 5,793,710 to Jacobi, U.S. Pat. No. 6,118,735 to Li and U.S. Pat. No. 6,819,632 to Paul disclose watches with removable watch faces. One common feature and drawback with these prior art watches, is that when the watch housing is opened to allow access to the watch face, the hour, minute and second hands become exposed, and since they are very fragile there is a great likelihood that they will be damaged by anyone who is not a professional watchmaker working in a controlled environment. Thus, this kind of interchangeable watch face is not suitable for consumers to change a watch face by themselves.

In the above-listed prior art is an alternate approach for interchangeable watch faces, namely, to provide an opening in the form of a slit in the side wall of the watch casing, so that a watch face can be slid out of the casing through the slit, and a replacement watch face slid into the casing via the slit. Here, the watch face would be positioned parallel to and below the plane of the hands. In this kind of arrangement, there is typically a drive shaft extending from the watch movement perpendicularly upward to and fixedly connected to the hands. This drive shaft is usually a series of three concentric tubes which are very tiny in nature. In order to use a replaceable watch face that slides in from the side, such watch face needs to have a notch extending from a peripheral edge radially inward to the center, so that the watch face can be positioned to have the notch straddle the drive shaft as it is slid into place, as seen in prior art patents, U.S. Pat. Nos. 4,660,992, 5,793,710, and 6,118,735.

A still further variation in structure is seen in U.S. Pat. No. 5,751,667 to Nunes, where there is an outer crystal and an inner transparent panel below the hands; however, these transparent elements are separable to gain access to the chamber below to change the golf tees or other graphic display articles, so that the hands become exposed to damage.

The present invention seeks to provide an alternative solution to the problem of establishing different appearances for a single wristwatch in a simple, convenient, inexpensive manner which is also safe from risk and damage to the hands of the watch.

SUMMARY OF THE INVENTION

A wristwatch according to an exemplary embodiment of the invention includes a casing having top and bottom parts and a movement therein, an upper housing, a replaceable watch face and a means for releasably securing the upper housing to the top part of the casing. The upper housing is formed as an integral unit, and includes top and bottom transparent panels, a drive shaft means extending through the bottom transparent panel, the drive shaft means having top and bottom ends, time indicating hands fixed to the top ends of the drive shaft means, and side walls fixed to and maintaining the top and bottom transparent panels spaced apart to define a chamber therein for enclosing the time indicating hands. The replaceable watch face includes a memory element, and a flat panel display disposed over the memory element. The replaceable watch face is situated below the bottom transparent panel and above the casing top part, and the bottom end of the drive shaft means is releasably coupled to the movement.

In at least one embodiment, the memory element is a flash memory card.

In at least one embodiment, the flat panel display is a liquid crystal display, a digital light projection display or a plasma display.

In at least one embodiment, the wristwatch further includes drive and programming circuitry disposed within the casing.

In at least one embodiment, the wristwatch further includes drive and programming circuitry disposed within the replaceable watch face.

These and other features of this invention are described in, or are apparent from, the following detailed description of various exemplary embodiments of this invention.

BRIEF DESCRIPTION OF THE DRAWINGS

Various exemplary embodiments of this invention will be described in detail, with reference to the following figures, wherein:

FIG. 2 is a top plan view thereof;

FIG. 3 is an exploded view in section taken along lines 3—3 in FIG. 2;

FIG. 4 is a top plan view of a second embodiment of the new wristwatch;

DETAILED DESCRIPTION OF THE PREFERRED EMBODIMENT

Figure 1:
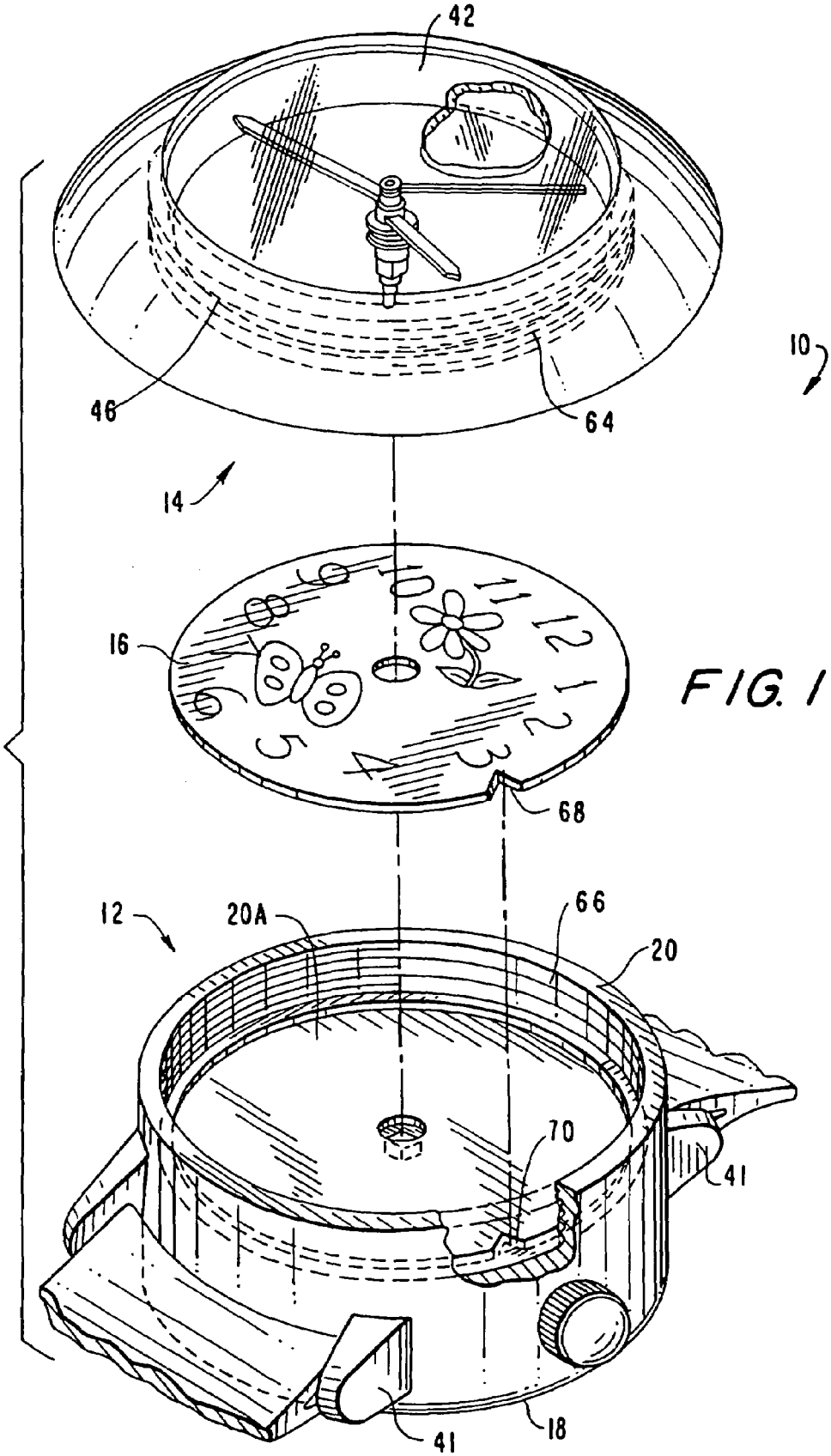
FIG. 1 is an exploded perspective view shown schematically of the new wristwatch of this invention.

FIG. 1 is a schematic drawing showing an exploded perspective view of a wristwatch 10 according to an exemplary embodiment of the invention. The three basic components of this wristwatch are the casing 12, the upper housing 14 and the replaceable watch face 16. FIGS. 2, 3 and 4 show the casing 12 and upper housing 14 in greater detail.

The casing 12 has a bottom formed by panel 18, a top part 20 including a top panel 20A, peripheral side walls 22 with a first chamber 26 defined between the top and bottom panels and the side walls 22. It is preferable that the casing walls 22 define a circular cylinder with internal threads 28 on the inside wall surfaces above the top panel 20A; however, the casing outer walls 22 may take a variety of other shapes, which are not necessarily round.

Within chamber 26 is mounted a watch movement 32 well known in the prior art which includes a motor and a replaceable battery (not shown), drive means 34 and an adjustment shaft 36 and knob 38 situated external of the side walls. The drive means 34 includes at least two and usually three rotatable elements for rotating hour, minute and second hands respectively, such drive means also being well known in the prior art. The casing 12 also includes typical shelf-like projections 41 on opposite ends thereof connectible to opposite ends of a wristband or bracelet.

The replaceable watch face 16 is situated atop the top panel 20A of the casing 12 with means to be described later for positioning and maintaining this or any replacement watch face in the predetermined orientation relative to the casing, to coordinate with the time indicating hands.

The upper housing 14 is formed as a removable self-contained integral unit or cartridge which can be screwed into the casing or unscrewed and removed to allow replacement of the watch face with an alternate watch face. This cartridge is formed of a transparent crystal 42 at the top, a transparent base 44 at the bottom, and side walls formed by a cylindrical rim 46 which maintains the crystal 42 and base 44 spaced apart to define a second chamber 48 which surrounds and protects the time indicating hands 50, 51 and 52. Situated at the center of the transparent base 44 is a bushing 54 and drive shaft means 56 comprising three concentric shafts 57, 58 and 59 corresponding and fixed to the hands 50, 51 and 52 respectively. This bushing is fixed axially in base 44 and allows the shafts 57, 58 and 59 to rotate freely therein. The shafts 57, 58 and 59 are typically outer and inner concentric tubes and a solid rod or additional concentric tube within the inner tube. The bottom ends of these shafts are releasably coupled to the drive elements of the drive means of the movement.

In some embodiments the drive means 34 may extend upward above the top panel 20A; alternatively the drive means 34 remains below 20A. At the bottom outside peripheral surface of the rim 46 are external threads 64 for threaded engagement with internal threads 66 in the casing 12 when the upper housing 14 is joined to the casing 12 with the watch face 16 captured between them. Other coupling means without screw threads are possible for releasably securing the upper housing 14 to the casing 12 below.

As is evident, the watch face 16, selected by the user, is clearly visible through the crystal 42 and base 44. Because the upper housing 14 is so easily separable from the casing, watch faces can be frequently and easily interchanged. Whenever a replacement watch face 16 is installed, its proper orientation may be automatically established and maintained by notch 68 cut in a peripheral edge of the watch face 16 engaging a projection 70 on the top surface of panel 20A of the casing. Numerous other positioning means are readily possible, including a projection from the watch face into a recess in the casing, or guide surfaces of the watch face and the casing.

The transparent crystal and base of the upper housing 14 may be made of glass or plastic, and the rim or side walls 46 that separate the crystal from the base may be preferably metal, plastic or other similar material. Also, the crystal and/or the base may be configured such that their mutual peripheral edges are joined without need between them of a separate side wall or cylindrical rim component.

With the structure as disclosed above, the upper housing 14 is a fixed unit of transparent crystal, transparent base, rim, if utilized, hands and drive shafts. The hands are fully protected from contact with a person's fingers, or with the replaceable watch face or with anything. The routine for removing a watch face and substituting a new watch face is extremely simple, quick and failsafe. Obviously, there is no limit to the number of different watch faces a user can acquire and use. Furthermore, a user can easily make and/or design his or her own watch faces and graphics thereon.

Figure 5:
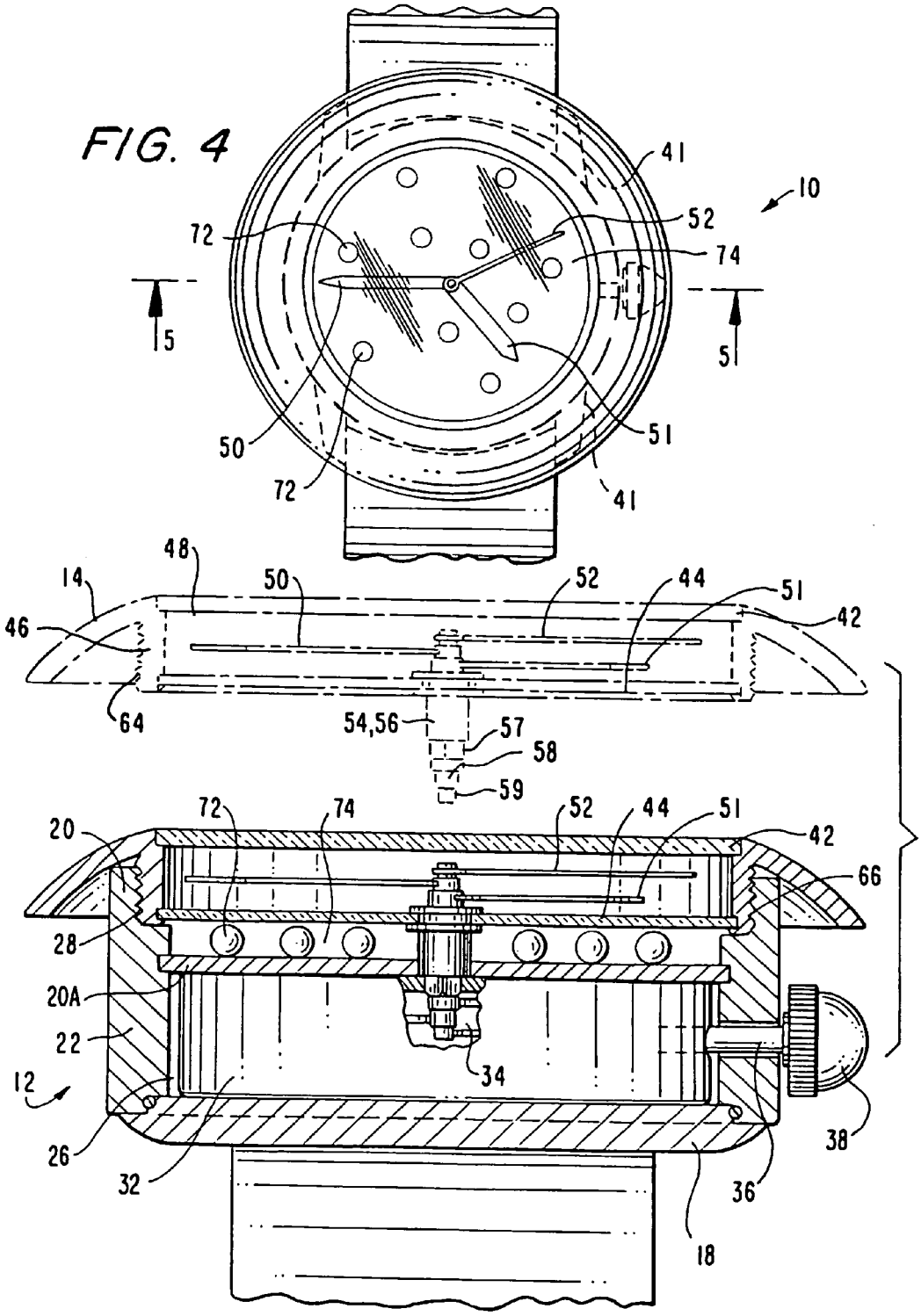
FIG. 5 is an exploded view in section taken along lines 5—5 in FIG. 4.

FIGS. 4 and 5 illustrate a further embodiment of this invention which has many similarities to the wristwatch of FIGS. 1–3 and use the same reference numbers for components which are the same as those in FIGS. 1–3. The principal difference is that instead of a removable watch face 16 being in the form of a thin sheet situated in a thin space above panel 20A and below lower transparent base 44 in FIGS. 1–3, the changeable visual effect seen in FIGS. 4 and 5 is achieved by movable articles 72 such as tiny balls or other miniature ornamental articles dimensioned to be freely movable in space 74 above panel 20A and below transparent base 44. In this further embodiment, the visual effect of the watch face is not only changeable by substituting different movable articles while the hands remain fully protected, but the visual appearance is changeable merely by movement of the articles. Also, one could utilize both a substitute watch face and substitute movable articles within space 74 while the wristwatch is being worn.

Figure 6:
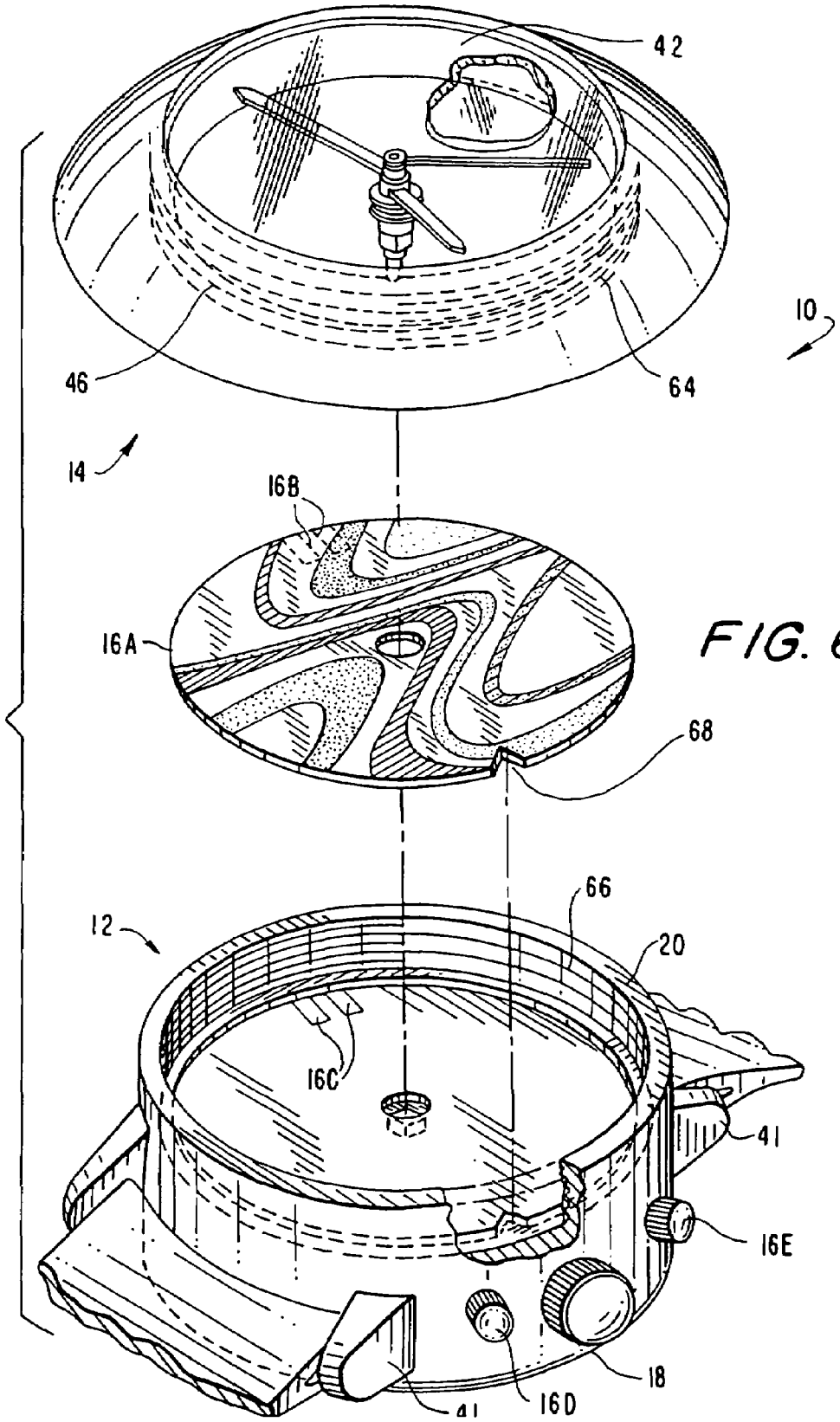
FIG. 6 is an exploded perspective view similar to FIG. 5 of a third embodiment of the new wristwatch with an electroluminescent display.

FIG. 6 shows a wristwatch according to another exemplary embodiment of the invention, this drawing being similar to FIG. 1 and for convenience of description, having the same reference numbers for similar or identical components. The relevant difference is that the watch face 16A is an electroluminescent display ("ELD"), the technology of which is known the prior art, examples being products from (a) epartyunlimited.com at www.gotglow.com, (b) MX5Parts.co.uk at www.MX5Parts.co.uk, (c) Trident Display Products at www.tridentdisplays.co.uk, and (d) All Electronics Corp., Van Nuys, Calif.

The watch face 16A using luminescent display technology provides a prescribed illuminated visual image which may change pursuant to a program or by manual control. Since the displays available in the watch face are limited to the original programming, this ELD watch face may be replaced by others with different displays, by simply separating the upper housing 14 from the lower housing or casing 12 as described earlier and substituting a different ELD watch face.

When the ELD watch face is installed its electrical contacts 16B become electrically connected to contacts 16C in the bottom of casing 12. To activate or control this ELD watch face, there are one or more control buttons 16D and 16E for on/off control and for selecting display programs. Drive and programming circuitry are included either on the ELD panel or in the casing.

Figure 7:
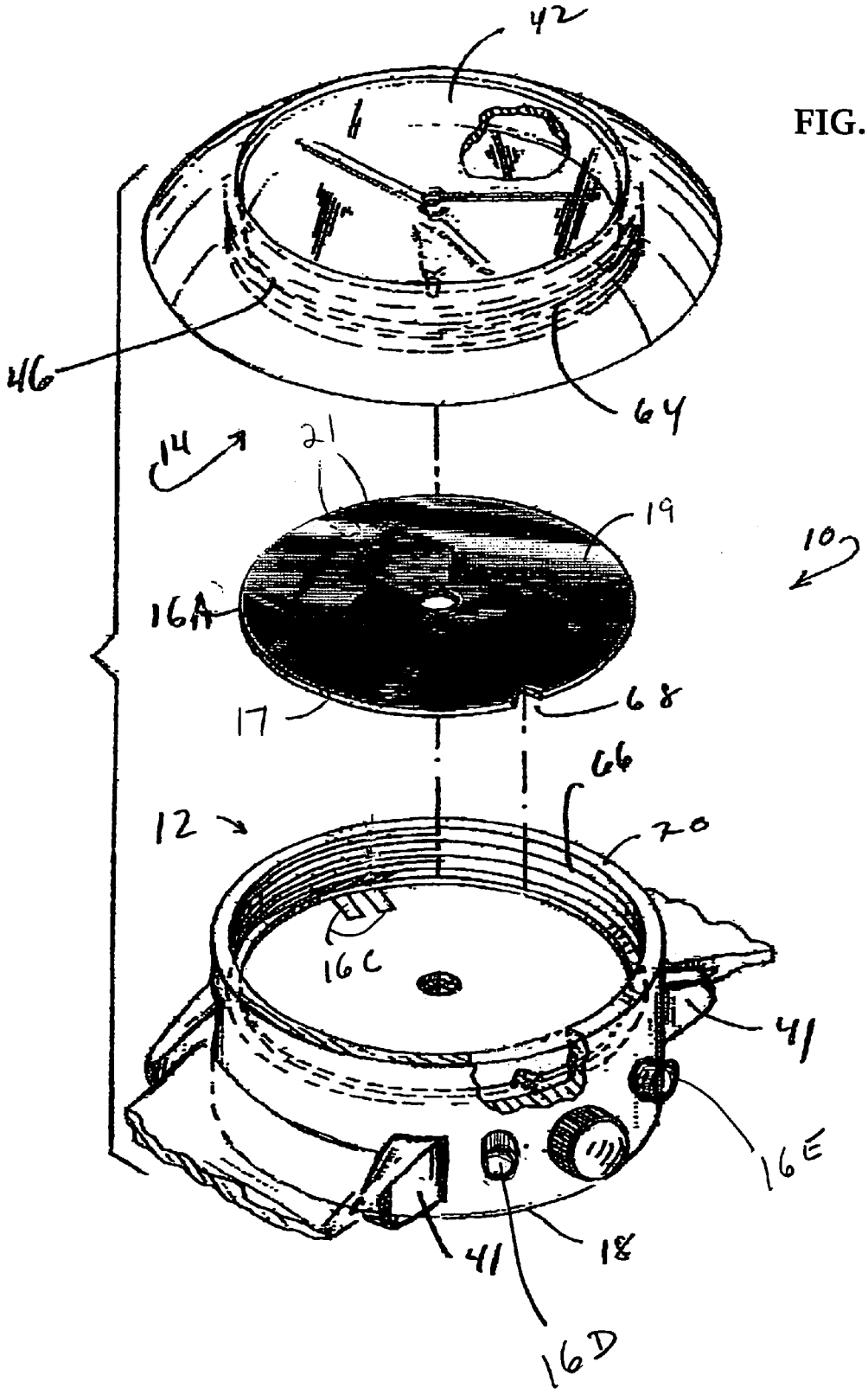
FIG. 7 is an exploded perspective view of a wristwatch according to another exemplary embodiment of invention.
Figure 8:
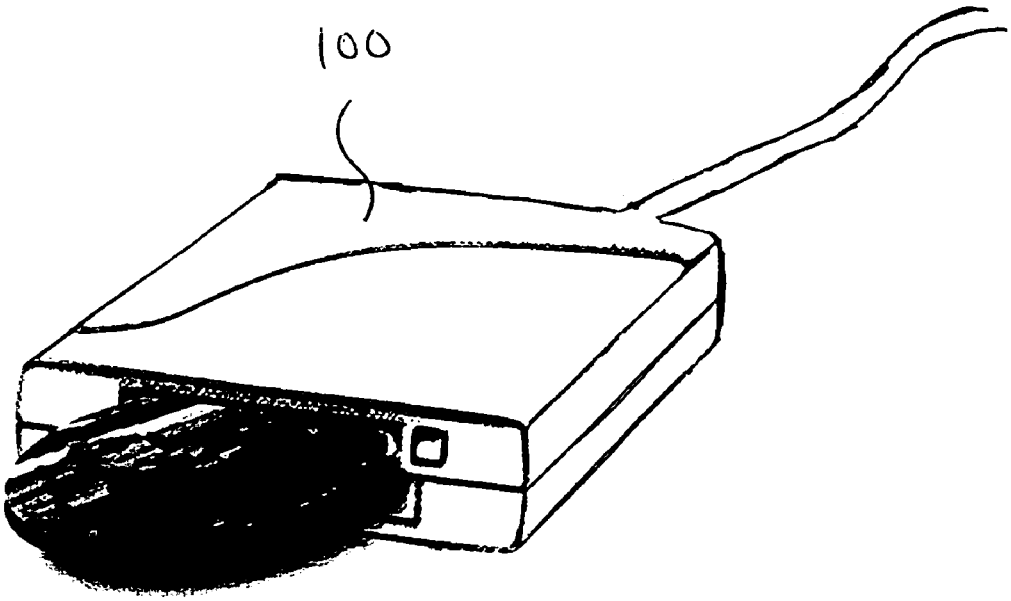
FIG. 8 is a read/write device useable with the wristwatch of FIG. 7 according to an exemplary embodiment of the invention.

FIGS. 7 and 8 show features of a wristwatch according to another exemplary embodiment of the invention. For convenience of description, FIG. 7 has the same reference numbers for similar or identical components as those shown in previous figures. In the present embodiment, the watch face 16A includes a flat digital memory element 17 and a flat panel display 19 disposed over the digital memory element 17. The memory element 17 and flat panel display 19 are preferably laminated together or otherwise combined to form a very thin wafer-like piece. The memory element 17 functions as storage capacity for digital images, videos and data, and is preferably in the form of a flash card typically used in still and video cameras. Such flash memory cards are available from SanDisk Corporation of Sunnyvale, Calif. The flat panel display 19 may use any known or later-discovered flat panel display technology, including, for example, digital light projection (DLP), liquid crystal display (LCD) and plasma technology. Such flat panel displays are available from, for example, Sony Corporation of Tokyo, Japan.

The watch face 16A using flat panel display and storage capacity technology according to the present embodiment provides color images, video or data which may change pursuant to a program or by manual control. Since the displays available in the watch are limited by the capacity of the memory element 17, the watch face 16A may be replaced to display different images, videos and/or data by simply separating the upper housing 14 from the lower housing or casing 12 as described for previous embodiments of the invention and substituting a different watch face 16A. Alternatively, the watch face 16A could be removed and placed in a read/write device, such as the read/write device 100 shown in FIG. 8, to receive more and/or different data. For example, if the memory element 17 is a flash memory card, the read/write device 100 may be a flash memory read/write device, such as those available from Lexar Media, Inc. of Fremont, Calif. In this regard, the memory element 17 may be detachable from the flat panel display 19 so that the memory element 17 may be placed within standard read/write devices.

In the present embodiment of the invention, drive and programming circuitry may be included on the watch face 16A and/or within the casing 12. The watch face 16A includes electrical contacts 21, which electrically connect with electrical contacts 16C located within the casing 12. One or more control buttons 16D, 16E may extend from the sides of the casing 12 and may be used, for example, to turn the display 19 on and off or to select display programs.

The watch face 16A of the present embodiment may also include a frame (not shown) disposed around the flat panel display 19 and over the memory element 17. The frame may have a circular outer profile, or any other profile that matches the general profile of the casing walls, with a square or rectangular opening through which the flat panel display 19 may be exposed. Such a frame would allow the more conventionally-shaped flat panel displays to be used with the present invention.

It is to be understood that while certain forms of the present invention have been illustrated and described herein, it is not to be limited to the specific forms or arrangement of parts described and shown.

What is claimed is:

1. A wristwatch comprising:

a. a casing having top and bottom parts and a movement therein, b. an upper housing formed as an integral unit, comprising:

(i) top and bottom transparent panels, (ii) drive shaft means extending through the bottom transparent panel, the drive shaft means having top and bottom ends, (iii) time indicating hands fixed to the top ends of the drive shaft means, and (iv) side walls fixed to and maintaining the top and bottom transparent panels spaced apart to define a chamber therein for enclosing the time indicating hands, c. a replaceable watch face, the replaceable watch face comprising:

(i) a memory element, and (ii) a flat panel display disposed over the memory element, d. means for releasably securing the upper housing to the top part of the casing, with the replaceable watch face situated below the bottom transparent panel and above the casing top part, and with the bottom end of the drive shaft means releasably coupled to the movement.

2. The wristwatch of claim 1, wherein the memory element is a flash memory card.

3. The wristwatch of claim 1, wherein the flat panel display is a liquid crystal display, a digital light projection display or a plasma display.

4. The wristwatch of claim 1, further comprising drive and programming circuitry disposed within the casing.

5. The wristwatch of claim 1, further comprising drive and programming circuitry disposed within the replaceable watch face.

* * * * *